US008469719B2

(12) United States Patent
Norris et al.

(10) Patent No.: US 8,469,719 B2
(45) Date of Patent: Jun. 25, 2013

(54) CONNECTOR TERMINAL FOR LAMPS

(75) Inventors: Brian K Norris, Madison, IN (US); Charles P. O'Neal, Lexington, IN (US)

(73) Assignee: Grote Industries, Inc., Madison, IN (US)

( * ) Notice: Subject to any disclaimer, the term of this patent is extended or adjusted under 35 U.S.C. 154(b) by 150 days.

(21) Appl. No.: 13/006,035

(22) Filed: Jan. 13, 2011

(65) Prior Publication Data

US 2012/0021656 A1 Jan. 26, 2012

Related U.S. Application Data

(60) Provisional application No. 61/295,863, filed on Jan. 18, 2010.

(51) Int. Cl.
*H01R 9/09* (2006.01)

(52) U.S. Cl.
USPC ..... 439/57; 362/646

(58) Field of Classification Search
USPC ..... 439/57, 613, 646, 800; 362/249.02
See application file for complete search history.

(56) References Cited

U.S. PATENT DOCUMENTS

| | | | | | |
|---|---|---|---|---|---|
| 4,318,158 | A * | 3/1982 | Livermore et al. | ..... | 362/29 |
| 4,593,958 | A * | 6/1986 | Baba | ..... | 439/77 |
| 4,628,421 | A * | 12/1986 | Saar | ..... | 362/238 |
| 4,965,457 | A | 10/1990 | Wrobel et al. | | |
| 5,536,175 | A * | 7/1996 | Forish | ..... | 439/57 |
| 5,947,588 | A | 9/1999 | Huang | | |
| 6,135,780 | A * | 10/2000 | Kelwaski et al. | ..... | 439/57 |
| 6,824,390 | B2 * | 11/2004 | Brown et al. | ..... | 439/57 |
| 7,758,222 | B2 * | 7/2010 | Malone et al. | ..... | 362/546 |

FOREIGN PATENT DOCUMENTS

| | | | |
|---|---|---|---|
| DE | 197 05 738 | A1 | 8/1998 |
| GB | 1 464 598 | A | 2/1977 |
| JP | 2002 343104 | A | 11/2002 |

OTHER PUBLICATIONS

Nuckolls, B., "FastOn® Tabs v. Ring Terminals . . . What's the Difference?", 1998, pp. 1-5.
European Application No. 11250052.5 Search Report mailed Oct. 4, 2012.

* cited by examiner

*Primary Examiner* — Hien Vu
(74) *Attorney, Agent, or Firm* — Woodard, Emhardt, Moriarty, McNett & Henry LLP

(57) ABSTRACT

An electrical connection device for a lamp housing is disclosed. The electrical connection device allows for simple and straightforward alignment of circuit connector terminals with conductive power connection pads on a lamp circuit board within a lamp housing.

8 Claims, 4 Drawing Sheets

CONNECTOR TERMINAL FOR LAMPS

CROSS-REFERENCE TO RELATED APPLICATIONS

The present application claims the benefit of U.S. Provisional Patent Application Ser. No. 61/295,863 filed Jan. 18, 2010, which is hereby incorporated by reference in its entirety.

FIELD OF THE DISCLOSURE

The present disclosure relates to electric lamps, and more particularly to a connector terminal for lamps.

BACKGROUND OF THE DISCLOSURE

There are many lamps known in the art for various applications. To give just one example, a wide variety of lamps are used on automotive vehicles. There are expected common connection systems for such lamps, both for OEM applications and repair and retrofit applications. For example, it is extremely common for lamps to allow either ring terminal connections, connections using FASTON® connectors, or connections which are specifically shaped to mate with specific sealed and unsealed plug ins from various manufacturers such as Amp Incorporated, Delphi Corporation and Deutsch, to name just a few non-limiting examples. In certain applications, it is also a common requirement that the terminals and the lamp housing provide a sealed connection so that the interior of the lamp housing is not exposed to the elements.

Such connection systems are relatively straightforward to manufacture in the case of incandescent or halogen sealed beam lamps, or lamps with plastic housings; however, providing such connectors in an LED lamp unit with aluminum or other metal housings for heat sinking, where the connector must be attached to a circuit board to which the LED lamps are mounted, can require quite a significant amount of hand assembly work involving the routing and soldering of wires. Additionally, providing a plurality of connection systems for a specific lamp having a plastic housing requires separate costly tooling for each different connection system.

There is therefore a need for a system and method to provide a connector terminal for lamps. The present disclosure is directed toward systems and methods which meet this and other needs.

SUMMARY OF THE DISCLOSURE

An electrical connection device for a lamp housing is disclosed. The electrical connection device allows for simple and straightforward alignment of circuit connector terminals with conductive power connection pads on a lamp circuit board within a lamp housing.

In one embodiment, a connector terminal assembly for a lamp housing is disclosed, comprising a connector housing; a first circuit connector disposed within the connector housing; a second circuit connector disposed within the connector housing; a first lamp connector disposed within the connector housing and conductively coupled to the first circuit connector; a second lamp connector disposed within the connector housing and conductively coupled to the second circuit connector; and a circuit board comprising a first circuit board surface; a circuit board opening formed through the circuit board; a first conductive power connection pad formed on the circuit board surface and disposed adjacent the circuit board opening; and a second conductive power connection pad formed on the circuit board surface and disposed adjacent the circuit board opening; wherein the circuit board is disposed between the first and second circuit connectors and the first and second lamp connectors; wherein the first and second circuit connectors may be withdrawn through the circuit board opening when the connector housing is oriented in a first position; and wherein the first and second circuit connectors may not be withdrawn through the circuit board opening when the connector housing is oriented in a second position rotated through a first angle from the first position.

In another embodiment, a method of installing a connector terminal assembly, the method comprising the steps of: (a) providing a connector terminal assembly comprising a connector housing; a first circuit connector disposed within the connector housing, the first circuit connector having an approximately 90 degree bend formed therein; a second circuit connector disposed within the connector housing, the second circuit connector having an approximately 90 degree bend formed therein; (b) providing a circuit board a circuit board, comprising a first circuit board surface; a circuit board opening formed through the circuit board; a first conductive power connection pad formed on the circuit board surface and disposed adjacent the circuit board opening; and a second conductive power connection pad formed on the circuit board surface and disposed adjacent the circuit board opening; (c) inserting the connector terminal assembly through the circuit board opening such that the first and second circuit connectors are disposed adjacent the circuit board surface; and (d) rotating the connector housing until the first and second circuit connectors are aligned with respective ones of the first and second conductive power connection pads.

In another embodiment, a connector terminal assembly for a lamp housing is disclosed, comprising a connector housing, a first circuit connector disposed within the connector housing, a second circuit connector disposed within the connector housing; and a circuit board comprising a first circuit board surface, and a circuit board opening formed through the circuit board, wherein the circuit board is disposed between the first and second circuit connectors and the first and second lamp connectors, wherein the first and second circuit connectors may be withdrawn through the circuit board opening when the connector housing is oriented in a first position, and wherein the first and second circuit connectors may not be withdrawn through the circuit board opening when the connector housing is oriented in a second position rotated through a first angle from the first position.

Additional embodiments are also disclosed.

DESCRIPTION OF THE ILLUSTRATED EMBODIMENTS

Figure 1:
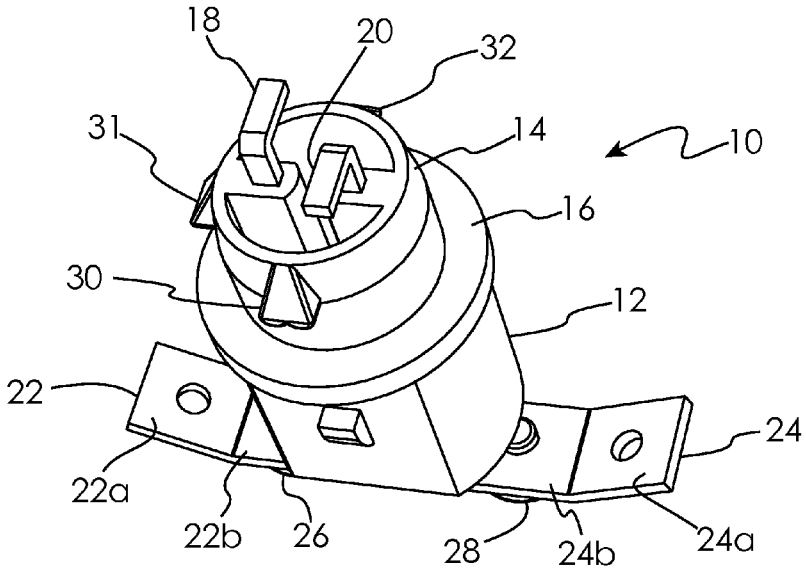
FIG. 1 is a perspective view of a molded socket according to an embodiment of the present disclosure.
Figure 2:
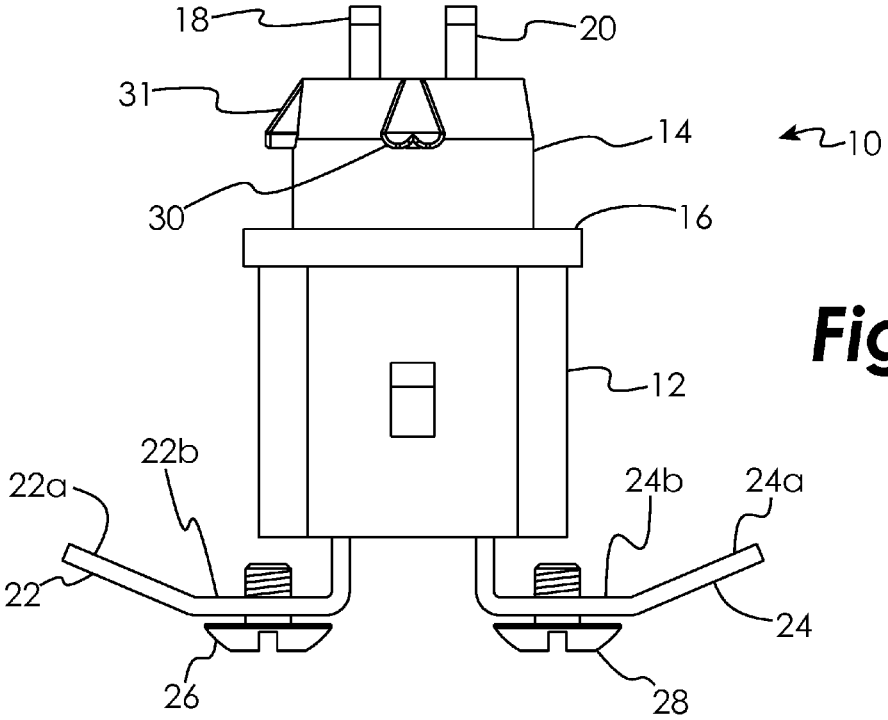
FIG. 2 is a side elevational view of the embodiment of FIG. 1.
Figure 3:
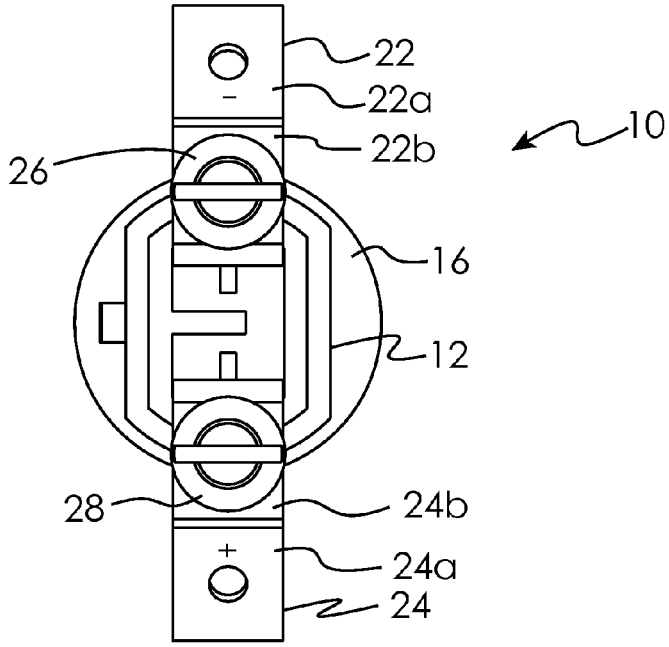
FIG. 3 is a bottom plan view of the embodiment of FIG. 1.
Figure 4:
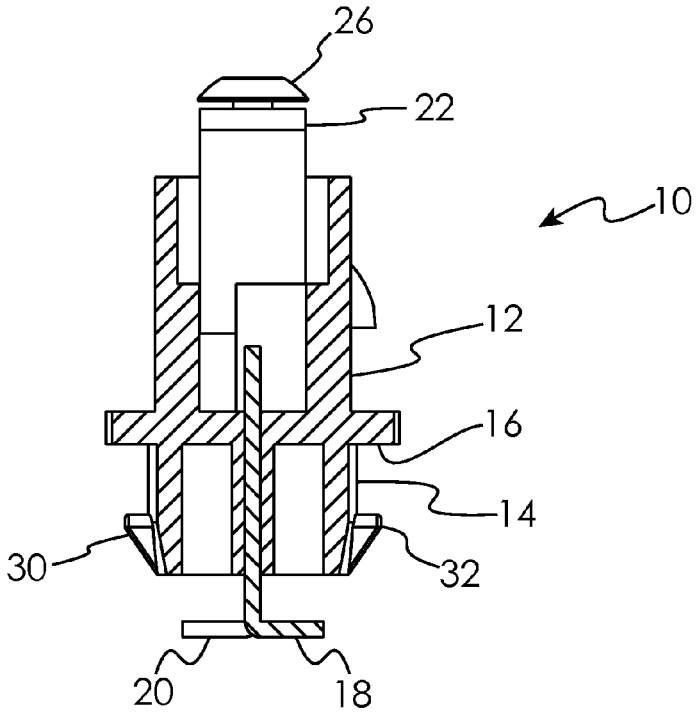
FIG. 4 is a cross-sectional view of the embodiment of FIG. 1.

For the purposes of promoting an understanding of the principles of the disclosure, reference will now be made to the embodiments illustrated in the drawings and specific language will be used to describe the same. It will nevertheless be understood that no limitation of the scope of the disclosure is thereby intended, and alterations and modifications in the illustrated systems, and further applications of the principles of the disclosure as illustrated therein are herein contemplated as would normally occur to one skilled in the art to which the disclosure relates.

In certain embodiments, the present disclosure is directed to a system which provides a connector to a lamp, wherein the connector is easily attached to a circuit board within the lamp.

In certain other embodiments, the present disclosure is directed to a system which provides a connector system for an LED lamp, where the connector easily mounts to a circuit board carrying the LEDs and provides connection points for ring terminals and/or FASTON® terminals. In other embodiments, the present disclosure is directed to a system which provides a connector system for an LED lamp, where the connector easily mounts to a circuit board carrying the LEDs and provides connection points for any design of sealed or unsealed connector. In certain embodiments, the present disclosure is directed to a system which provides a sealed connector system.

Referring to FIGS. 1-4, there is shown an example lamp connector 10 having a first base section 12 and a second base section 14 separated by an annular sealing surface 16. In certain embodiments, the base sections 12, 14 and annular sealing surface 16 are formed as in integral unit, such as by injection molding a plastic material such as polyvinylchloride, to name just one non-limiting example. Those skilled in the art will recognize that the base sections 12, 14 and annular sealing surface 16 can be formed from any desired material or materials, using any desired forming process, and these are not critical to the presently disclosed devices and methods.

Sealed within base sections 12, 14 and annular sealing surface 16 are two circuit connectors 18, 20. Circuit connectors 18, 20 facilitate connection to a circuit board of the lamp (as discussed in greater detail hereinbelow). Also sealed within base sections 12, 14 and annular sealing surface 16 are two lamp connectors 22, 24. Lamp connectors 22, 24 facilitate connection of external conductive connectors to the device 10. Circuit connectors 18, 20 and lamp connectors 22, 24 are conductive. Circuit connector 18 is conductively coupled to lamp connector 22 within lamp housing sections 12, 14 and annular sealing surface 16, while circuit connector 20 is conductively coupled to lamp connector 24 within base sections 12, 14 and annular sealing surface 16. In certain embodiments, circuit connector 18 and lamp connector 22 are integrally formed, while circuit connector 20 and lamp connector 24 are integrally formed.

In some embodiments, lamp connector 22 includes portion 22*a* that allows for attachment of a FASTON® connector thereto, and a portion 22*b* having a threaded connector 26 allowing for mounting of a ring terminal thereto. Lamp connector 24 includes portion 24*a* that allows for attachment of a FASTON® connector thereto, and a portion 24*b* having a threaded connector 28 allowing for mounting of a ring terminal thereto. Those skilled in the art will recognize that FASTON® connectors are available from Amp Incorporated of Harrisburg, Pa. In certain embodiments, base section 14 includes projecting tangs 30, 31 and 32 that facilitate retention of the device 10 within the lamp housing, as explained in greater detail hereinbelow.

Figure 5:
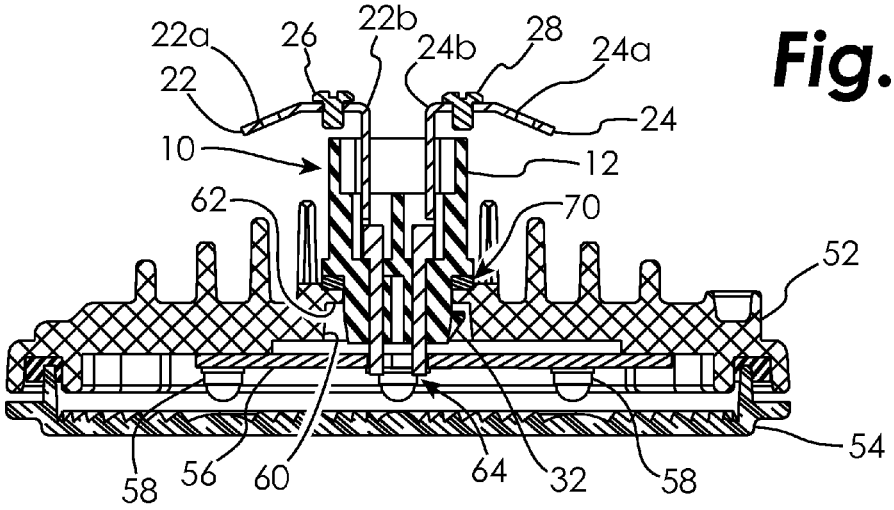
FIG. 5 is a cross-sectional view of the embodiment of FIG. 1 installed in an exemplary lamp housing.
Figure 6:
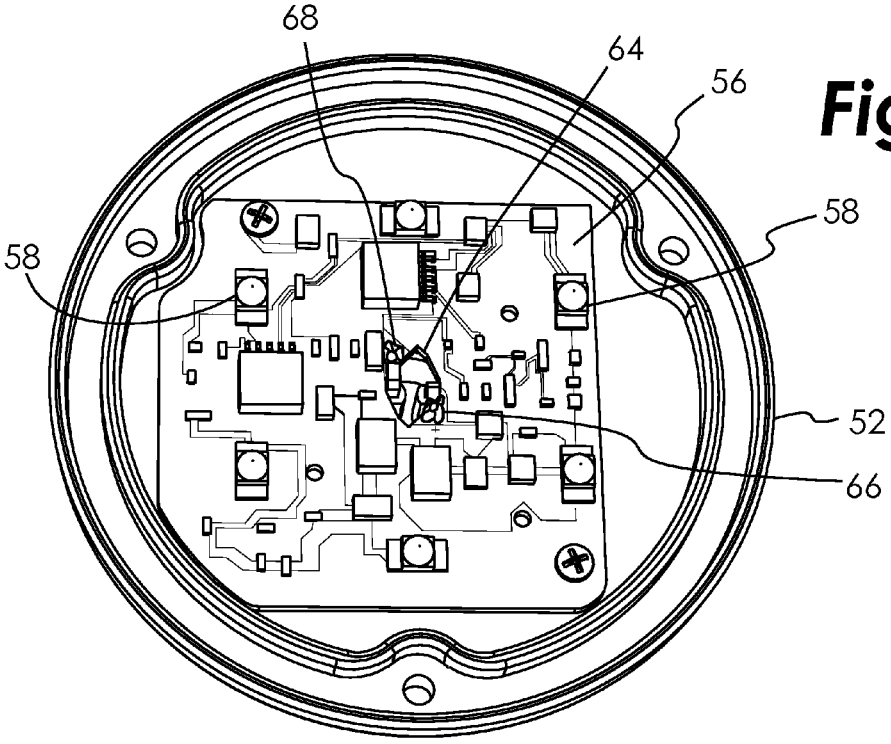
FIG. 6 is a first bottom plan view of the embodiment of FIG. 1 installed in an exemplary lamp housing.
Figure 7:
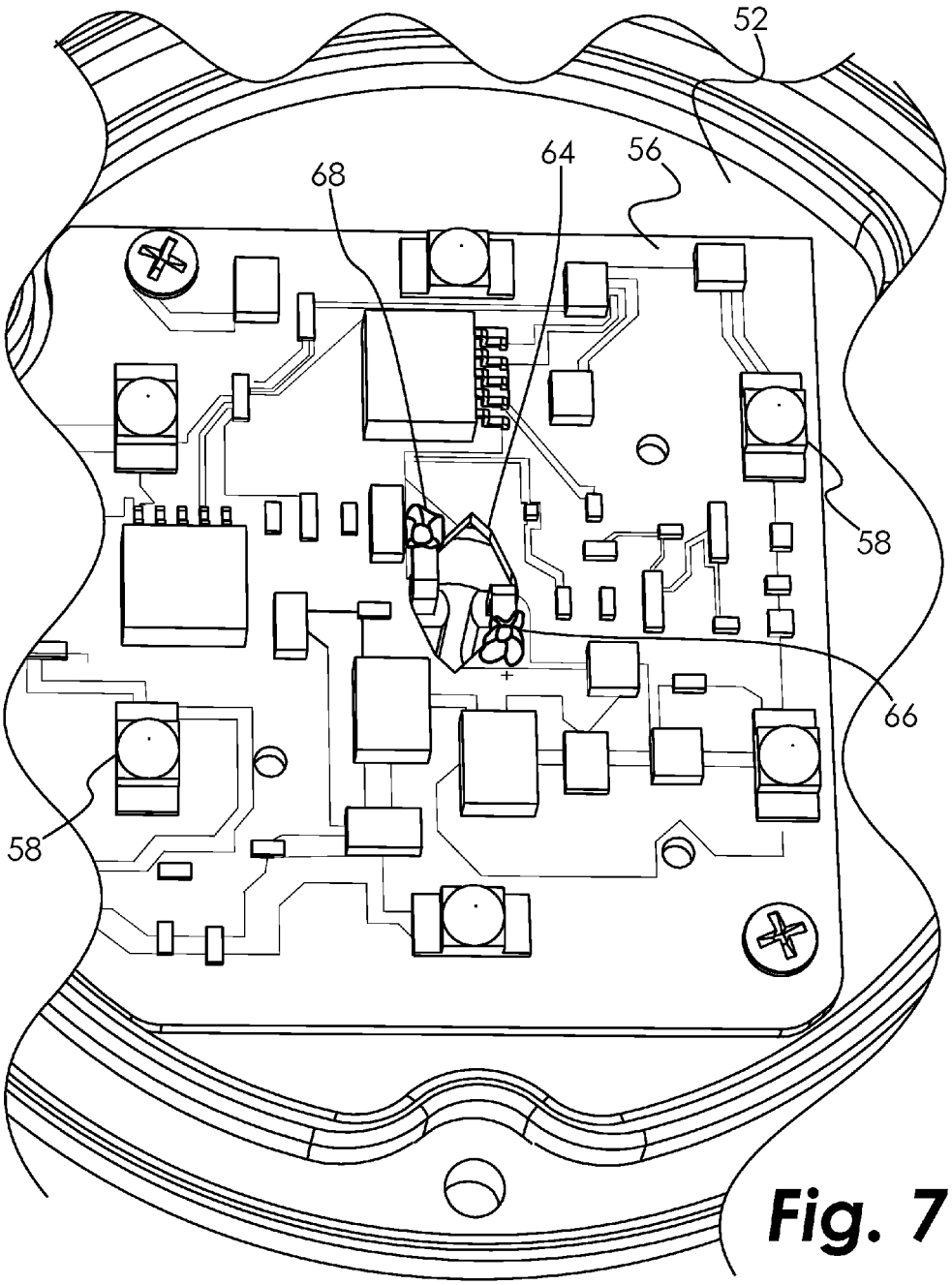
FIG. 7 is a second bottom plan view of the embodiment of FIG. 1 installed in an exemplary lamp housing.

Referring now to FIGS. 5-7, one embodiment of the device 10 is shown mounted to an exemplary lamp housing 52. Lamp housing 52 may be coupled to a lens 54. The manner of coupling the lamp housing 52 and the lens 54, and whether such coupling is removable or permanent, is not critical to the present invention. Mounted to the lamp housing 52 is a circuit board 56 to which are mounted one or more lamps 58, such as LED lamps, to give just one non-limiting example.

Lamp housing 52 includes a passageway 60 having an annular protrusion 62 formed therein. Circuit board 56 has an opening 64 formed therethrough, wherein the opening 64 is substantially aligned with the passageway 60. In some embodiments, the opening 64 has one axis that is longer than a second, transverse axis. Circuit board 56 further has a first conductive power connection pad 66 and a second conductive power connection pad 68 formed adjacent to opening 64. First conductive power connection pad 66 is provided for connection to circuit connector 18 and second conductive power connection pad 68 is provided for connection to circuit connector 20. In some embodiments, first conductive power connection pad 66 and a second conductive power connection pad 68 are solder pads conductively coupled to other electronic components mounted on the circuit board 56.

With continuing reference to FIGS. 5-7, mounting of the device 10 to the lamp housing 52 will now be described. An optional annular sealing ring 70 is mounted around the base section 14 such that it lies adjacent to annular sealing surface 16. With the lens 54 not yet coupled to the lamp housing 52, base section 14 is inserted into passageway 60 until annular sealing ring 70 is firmly compressed between annular sealing surface 16 and annular protrusion 62.

Projecting tangs 30 and 32 engage the opposite side of annular protrusion 62 in order to hold device 10 within the passageway 60 of the lamp housing 52. Tang 31 is provided to ensure that the base section 14 is inserted into the passageway 60 in the proper orientation, and a suitable opening (not shown) in passageway 60 ensures this. In some embodiments, the sealing ring 70 is placed in compression in this position. The compression of annular sealing ring 70 inhibits the passing of moisture, dust and/or other contaminants, while also sealing the lamp housing 52 to prevent leaking of encapsulant material (if used) from inside of the lamp housing 52 through the passageway 60.

In this position of the device 10, the circuit connectors 18, 20 have passed through the opening 64 and are positioned on the opposite side of circuit board 56 as the lamp housing section 14. Rotating the device 10 through approximately 45 degrees brings the circuit connectors 18, 20 into alignment with first conductive power connection pad 66 and a second conductive power connection pad 68, respectively. A protrusion (not shown) in the lamp housing 52 prevents the device 10 from being over-rotated during assembly. Once aligned, the circuit connector 18 may be conductively coupled to first conductive power connection pad 66 and the circuit connector 20 may be conductively coupled to second conductive power connection pad 68. Such conductive coupling may be made by any means known in the art, such as by soldering or welding, to give just two non-limiting examples. Thereafter, the lens 54 may be mounted to the lamp housing 52, as is known in the art.

In other embodiments, the device 10 is mounted within the lamp housing 52 prior to mounting the circuit board 56 to the lamp housing 52. The circuit board 56 is then inserted over the device 10 such that the circuit connectors 18, 20 pass through the opening 64. The circuit board 56 is then rotated in order to bring the circuit connectors 18, 20 into alignment with the first conductive power connection pad 66 and the second conductive power connection pad 68, respectively. Once aligned, the circuit connector 18 may be conductively coupled to first conductive power connection pad 66 and the circuit connector 20 may be conductively coupled to second conductive power connection pad 68. Such conductive coupling may be made by any means known in the art, such as by soldering or welding, to give just two non-limiting examples. The circuit board 56 may optionally be affixed to the lamp housing 52 by means other than the device 10, such as by screws or any other suitable connecting device(s). Thereafter, the lens 54 may be mounted to the lamp housing 52, as is known in the art.

Once the device 10 is mounted to the lamp housing 50, lamp connectors 22, 24 may be used to couple power from an external source, such as a vehicle power system, to the lamp (s) 58 in order to provide control in turning the lamp(s) 58 on and off. In the illustrated embodiment, lamp connectors 22, 24 include portions 22*a*, 24*a* that allow for attachment of FASTON® connectors thereto, and a portions 22*b*, 24*b* having threaded connectors 26, 28 allowing for mounting of ring terminals thereto. The illustrated embodiment allows easy connection of the lamp housing 52 to most existing vehicle electrical systems. In other embodiments, the device 10 may have means for connecting to only a single type of connector. In other embodiments, the device 10 provides connection points for any design of sealed or unsealed connector other than a FASTON® connector or a ring terminal.

It will be appreciated that the device 10 allows for simple and straightforward assembly of lamp connectors to a lamp housing, greatly easing the task of conductively coupling the lamp connectors to the electronic componentry of the lamp housing 52 during manufacturing.

It should be appreciated that although the present disclosure discusses the attachment of the device 10 to a circuit board incorporating LED lamps, it is contemplated that numerous types of lamps, such as incandescent and fluorescent lamps, may be used with the device 10, with the LED lamps 58 being non-limiting examples only. In addition to the numerous other types of lamps contemplated by the present disclosure, it is contemplated that a variety of other appropriate lamp housing and lens assemblies may be used with the device 10.

While the disclosure has been illustrated and described in detail in the drawings and foregoing description, the same is to be considered as illustrative and not restrictive in character, it being understood that only certain embodiments have been shown and described and that all changes and modifications that come within the spirit of the disclosure are desired to be protected.

What is claimed:

1. A lamp connector terminal assembly, comprising:

(a) a lamp housing having a lens on one side thereof and having a passageway through said lamp housing on an opposite side of said lens;

(b) a connector to couple power from an external source to a circuit board in said lamp housing, having:

a connector housing having a first base section external of said lamp housing and a second base section inserted through said lamp housing passageway;

an annular sealing surface disposed externally on said connector housing between the first and second base sections;

a first circuit connector disposed at least partially within the connector housing;

a second circuit connector disposed at least partially within the connector housing;

a first lamp connector disposed within the connector housing and conductively coupled to the first circuit connector;

a second lamp connector disposed within the connector housing and conductively coupled to the second circuit connector; and (c) the circuit board, comprising:

a first circuit board surface toward said lens and opposite said passageway through said housing;

a circuit board opening formed through the circuit board;

a first conductive power connection pad formed on the circuit board first surface and disposed adjacent the circuit board opening; and a second conductive power connection pad formed on the circuit board first surface and disposed adjacent the circuit board opening;

at least one LED lamp mounted to said first surface of said circuit board and conductively coupled to respective ones of the first and second conductive power connection pads;

wherein the first and second circuit connectors are conductively coupled to respective ones of the first and second conductive power connection pads;

wherein the circuit board is disposed between the first and second circuit connectors and the first and second lamp connectors;

wherein the first and second circuit connectors are initially oriented in a first position; and wherein the first and second circuit connectors are thereafter oriented in a second position rotated through a first angle from the first position until the first and second circuit connectors are aligned with respective ones of the first and second conductive power connection pads on said first surface toward said lens and opposite said passageway through said housing.

2. The lamp connector terminal assembly of claim 1, wherein the first base section, the annular sealing surface and the second base section comprise an integral plastic housing.

3. The lamp connector terminal assembly of claim 1, wherein:

the first circuit connector and the first lamp connector comprise a first integral conductive member; and the second circuit connector and the second lamp connector comprise a second integral conductive member.

4. The lamp connector terminal assembly of claim 1, wherein the first and second circuit connectors each comprise a conductive element having an approximately 90 degree bend therein.

5. The lamp connector terminal assembly of claim 4, further comprising: at least one tang projecting from a surface of the connector housing, the at least one tang operative to secure the connector housing in a lamp housing when mounted therein, wherein said tang secures to said housing between said housing and said circuit board.

6. The lamp connector terminal assembly of claim 1, further comprising:

at least one tang projecting from a surface of the connector housing, the at least one tang operative to secure the connector housing in a lamp housing when mounted therein.

7. The lamp connector terminal assembly of claim 1, wherein:

the circuit board opening has a longitudinal axis and a transverse axis; and a first dimension of the circuit board opening along the longitudinal axis is greater than a second dimension of the circuit board opening along the transverse axis.

8. The lamp connector terminal assembly of claim 1, wherein the first and second circuit connectors are soldered to respective ones of the first and second conductive power connection pads.

* * * * *